US005316502A

United States Patent [19]

Loet

[11] Patent Number: 5,316,502

[45] Date of Patent: May 31, 1994

[54] ELECTRICAL CONNECTOR WITH CIRCUIT PROTECTION

[75] Inventor: Farkas Loet, Freeport, N.Y.

[73] Assignee: Union Connector Co., Inc., Roosevelt, N.Y.

[21] Appl. No.: 867,252

[22] Filed: Apr. 10, 1992

[51] Int. Cl.[5] ..... H01R 83/68

[52] U.S. Cl. ..... 439/621

[58] Field of Search ..... 439/621, 622; 337/208, 337/209, 213, 216

[56] References Cited

U.S. PATENT DOCUMENTS

| | | | |
|---|---|---|---|
| 971,363 | 9/1910 | Doyle . | |
| 1,043,759 | 11/1912 | Fisher . | |
| 1,742,312 | 1/1930 | Hagel . | |
| 2,015,590 | 9/1935 | Cavanagh et al. | 173/323 |
| 2,171,726 | 9/1939 | Howell | 173/363 |
| 2,224,366 | 10/1940 | Johnston | 200/51 |
| 2,389,455 | 11/1945 | Benander | 173/363 |
| 2,420,865 | 5/1947 | Conlan | 200/50 |
| 2,441,465 | 5/1948 | Bauroth | 200/50 |
| 2,448,509 | 9/1948 | Anthony, Jr. et al. | 173/323 |
| 2,742,622 | 4/1956 | Stevens, Jr. | 339/60 |
| 2,782,391 | 2/1957 | Kirk | 339/211 |
| 2,907,973 | 10/1959 | Stevens, Jr. | 339/59 |
| 3,143,384 | 8/1964 | Senior, Jr. | 339/59 |
| 3,226,667 | 12/1965 | Senior, Jr. | 339/91 |
| 3,280,278 | 10/1966 | Ganzert | 200/51.09 |
| 3,281,558 | 10/1966 | Weber | 337/213 X |
| 3,598,941 | 8/1971 | Nelson | 200/51.09 |
| 3,644,869 | 2/1972 | Newman | 339/19 |
| 3,676,837 | 7/1972 | Newman | 339/103 R |
| 3,742,119 | 6/1973 | Newman | 174/65 |
| 3,777,298 | 12/1973 | Newman et al. | 339/16 R |
| 3,778,569 | 12/1973 | Newman et al. | 200/51.09 |
| 3,784,964 | 1/1974 | Newman et al. | 339/219 R |
| 3,944,316 | 3/1976 | Newman et al. | 339/111 |
| 4,029,383 | 6/1977 | Harding et al. | 339/97 |
| 4,060,299 | 11/1977 | Williams | 339/48 |
| 4,128,295 | 12/1978 | Bunnell | 339/274 |
| 4,128,296 | 12/1978 | Lauterbach et al. | 339/274 |
| 4,302,066 | 11/1981 | Newman et al. | 339/82 |
| 4,501,459 | 2/1985 | Chandler et al. | 339/48 |
| 4,595,251 | 6/1986 | Moulin | 339/47 |
| 4,695,110 | 9/1987 | Wasserlein | 439/289 |
| 4,795,360 | 1/1989 | Newman et al. | 439/278 |

*Primary Examiner*—Eugene F. Desmond
*Attorney, Agent, or Firm*—Kenyon & Kenyon

[57] ABSTRACT

The present invention is directed a circuit protection component including male and female cable connectors coupled to one another in a lightweight, easy to handle housing. A circuit protection device, such as a fuse, is mounted within the housing and arranged to electrically couple the male cable connector to the female cable connector. The housing can be easily installed at any location of a power distribution network by using the male and female connectors to couple one power cable to another power cable. Accordingly, a plurality of the circuit protection components can be strategically located at each branch or sub-branch circuit in a straightforward coupling of power cables feeding electric power to and forming the localized sections of the power distribution network.

6 Claims, 6 Drawing Sheets

ELECTRICAL CONNECTOR WITH CIRCUIT PROTECTION

FIELD OF THE INVENTION

The present invention is directed to electrical connectors, and more particularly, to electrical connectors for connecting power cables to one another in portable and temporary power distribution networks, each of the electrical connectors including circuit protection components.

BACKGROUND OF THE INVENTION

There are many buildings, facilities, sites and locations that require electric power and yet do not have fixed electric power distribution systems. There are also many sites and locations having power distribution needs that vary with time. Typically, the electric power requirements in such circumstances are provided by a portable power distribution facility that can be easily installed on a temporary basis, configured and reconfigured to any desired network of main power feed, trunk feeds and branch circuits and conveniently disassembled for storage and/or shipment to other locations. Examples of locations often requiring temporary or portable power distribution systems include motion picture and television production facilities, construction sites, convention and exhibit halls and any areas or locations during times of emergency such as earthquakes and the like.

Lugged cables provide an important component in such portable power distribution systems. Lugged cables comprise heavy, high power conductors having connector ends for coupling components of the power distribution system to one another. The cables are used to distribute power from, e.g., a portable generator to power distribution boxes and cabinets arranged throughout a location requiring power, and for connecting lighting fixtures, motors and other electrical equipment in branch circuits arranged about the power distribution boxes and cabinets.

As should be understood, safety is an important consideration in the design of cables and other components used to build portable or temporary power distribution systems. It is necessary to properly insulate high power cables and equipment from exposure to users and to insure that couplings and connectors are mechanically secure to prevent "live" cables from coming loose and presenting shock hazards. Moreover, over-current protection is also important to disconnect electrical branch circuits from a power source during branch overload or short circuit conditions to prevent shock hazards and fire.

While the prior art has provided important advances in leak tight insulation and secure mechanical couplings for power cables, over-current circuit protection is still a problem in portable and temporary power distribution networks, particularly in branch circuits remote from a portable generator or main power feed cabinet. Connector cables are often manufactured with heavy, insulating, rubber housings at the connector ends of the cable to cover and insulate connections between power cables. In addition, mechanical arrangements are installed at cable connector ends to lock cables to one another for high integrity of mechanical linkages between high power conductors. However, there is still a lack of adequate over-current protection mechanisms that can be easily and conveniently installed throughout the portable power distribution network, e.g., at each branch circuit of the network.

Far too often, the only over-current circuit protection comprises circuit breaker equipment located at a main power distribution panel. Cables provide trunk lines from the main panel to other power distribution boxes and cabinets located throughout the site where the power distribution system is installed. These power distribution boxes and cabinets, in turn, are connected by cables to many individual branch circuits providing power to the electrical equipment being utilized at the particular site. Consequently, an overload or short circuit condition at one of the many branch circuits may not result in a surge of current sufficient enough to activate a circuit breaker at the main panel, yet the overload is serious enough to cause a shock hazard or fire at the location of the branch circuit. Thus, there is a need for a portable over-current protection mechanism that can be conveniently installed at each branch circuit of a portable power distribution system to achieve highly localized over-current protection throughout the system.

SUMMARY OF THE INVENTION

The present invention provides a highly portable over-current protection mechanism that is arranged in an electrical connector component to facilitate the installation of circuit over-current protection at each local, branch circuit area of a power distribution system. According to one aspect of the present invention, the circuit protection component comprises male and female cable connectors coupled to one another in a lightweight, easy to handle housing. A circuit protection device, such as a fuse, is mounted within the housing and arranged to electrically couple the male cable connector to the female cable connector. The housing can be easily installed at any location of a power distribution network by using the male and female connectors to couple one power cable to another power cable. Accordingly, a plurality of the circuit protection components can be strategically located at each branch or sub-branch circuit in a straightforward coupling of power cables feeding electric power to and forming the localized sections of the power distribution network. Indeed, a circuit protection component can be installed at any location within the network, including individual electrical devices.

In accordance with another feature of the present invention, each cable connector is formed to include a locking mechanism at each of the male and female cable connectors to secure the cables coupled to one another by the circuit protection component for mechanical integrity. Thus, circuit protection against electrical overload hazards is reinforced by a locked mechanical coupling to prevent the occurrence of loose power cables.

As a further safety feature, the male and female connectors include unique mating elements so that a power feed cable of a certain power rating can only be coupled by the connector of the circuit protection component to a similar cable or a cable of even higher power rating. In this manner, a high power cable can not be physically coupled to a lower rated cable to prevent current overload due to improper cable connections.

In an exemplary embodiment of the present invention, the unique mating elements comprise a pin element arranged to extend along the longitudinal axis of the opening of a female connector of a cable used in the network or a component according to the present invention, and a corresponding opening formed in a respective male connector pin. The female pin is arranged to be received into the male opening upon coupling of two connectors. The female pin and male openings are dimensioned so that, e.g., a relatively high power rated cable has a relatively large diameter pin at its female connector that is too large to be received into the opening of a male connector for a lower rated power cable or circuit protection component.

Thus, by following a convention of utilizing female connectors for power outputs, a highest female connector power output will include a pin of maximum relative diameter that can only be received into a maximum diameter opening of the male connector of a highest power rated cable. At the other end of the spectrum, the pin of a lowest power female connector output will be the smallest relative diameter that can be received into the opening of a male connector of the lowest power rated cable or any higher rated cable. Any cable rated lower than a particular power output will necessarily have an opening in its male connector too small to receive the pin of the higher power rated female output.

It should be understood, of course, that the utilization of a relatively higher power rated cable, when coupled to a lower power output, will present no electrical hazard. Over current protection for a relatively low power branch circuit is obtained by the use of a proper fuse or circuit breaker. Thus, a relatively low power rated electrical connector according to the present invention, is provided with an appropriately rated circuit protection device and comprises a male connector input having an opening dimensioned to receive the pin of the female connector of an appropriately rated cable or a cable of lower power rating.

As a further feature of the present invention, each of the circuit protection components of the present invention can be arranged to provide circuit branching. For example, a male connector input can be coupled via individual circuit protection devices to a plurality of female connector outputs. Thus, a relatively high power rated cable can be used to feed power to two or more relatively lower power rated cables for branch circuit service. Each of the individual circuit protection devices is properly rated to the power load of the respective branch circuit and the safety mating elements are arranged for coupling of a relatively high power rated cable to the male connector input and a relatively low power rated cable to each of the female connector outputs of the circuit protection component.

DETAILED DESCRIPTION

Figure 1:
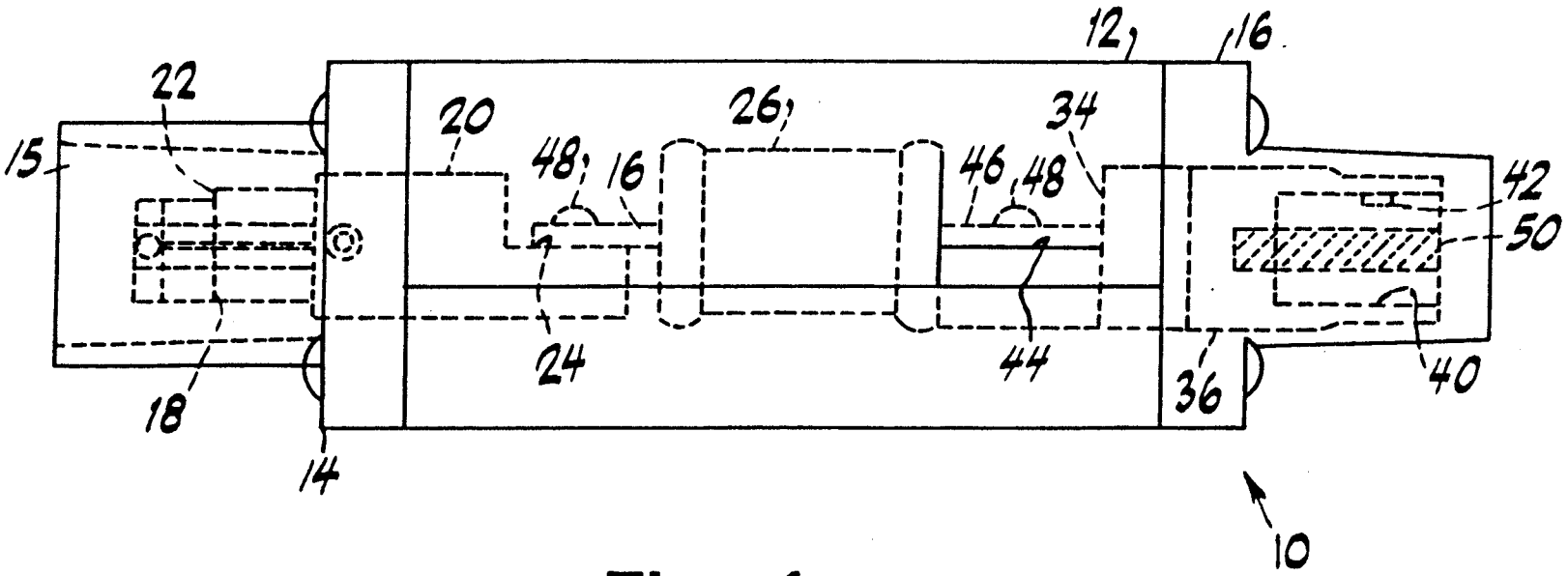
FIG. 1 is a side view of an exemplary circuit protection component according to the present invention, illustrating the internal components thereof in phantom lines.

Referring now to the drawings, and initially to FIGS. 1–5, an exemplary circuit protection component according to the present invention is generally indicated by the reference numeral 10. The circuit protection component 10 comprises a housing that can be formed as a cylindrical enclosure 12 made from a rugged plastic material. The enclosure 12 is arranged to mount a rubber, male connector panel mount 14 at one open end of the cylindrical enclosure 12 and a rubber, female connector panel mount 16 at the other open end, as most clearly illustrated in FIG. 2. The panel mounts 14, 16, each have a generally cylindrical open end 15, 17, respectively, to surround a respective electrical connector and thereby provide insulation for and completely isolate the male and female connectors from the surrounding environment, when they are coupled to one another. To that end, the inner diameter of each male connector panel mount end 15 is wide enough to receive the outer diameter of a female connector panel mount end 17 when a male connector within the male panel mount 14 is coupled to a respective female connector.

A male connector 18 is securely mounted by the male connector panel mount 14. The male connector 18 comprises an electrical conducting body 20 secured within a central opening 21 of the panel mount 14 and an integral, generally cylindrical male connection element 22 that extends within the cylindrical open end 15. The electrical conducting body 20 is formed to include a cut out portion defining a platform 24 for mounting a circuit protection device, such as a fuse 26, as will appear.

Figure 5:
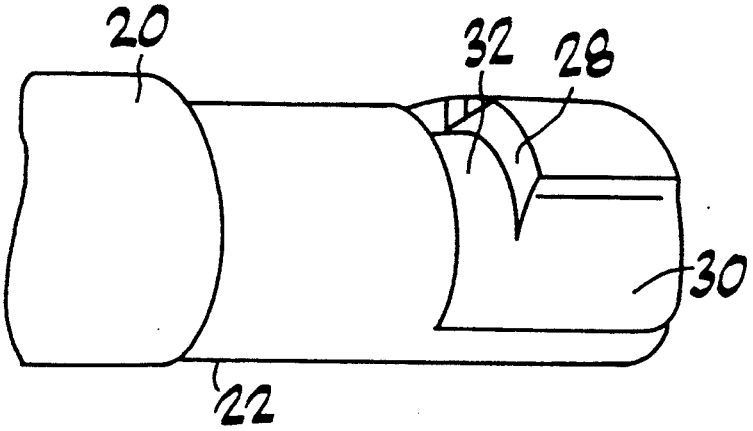
FIG. 5 is a perspective view of the male connector of FIG. 3.

As illustrated in FIG. 5, the male connection element 22 includes a groove formation 28 comprising a longitudinally disposed groove section 30 that communicates with a circumferentially disposed groove section 32. The groove formation 28 provides a mechanical locking mechanism when the male connection element 22 is coupled to a female connector, as will now be described.

Figure 2:
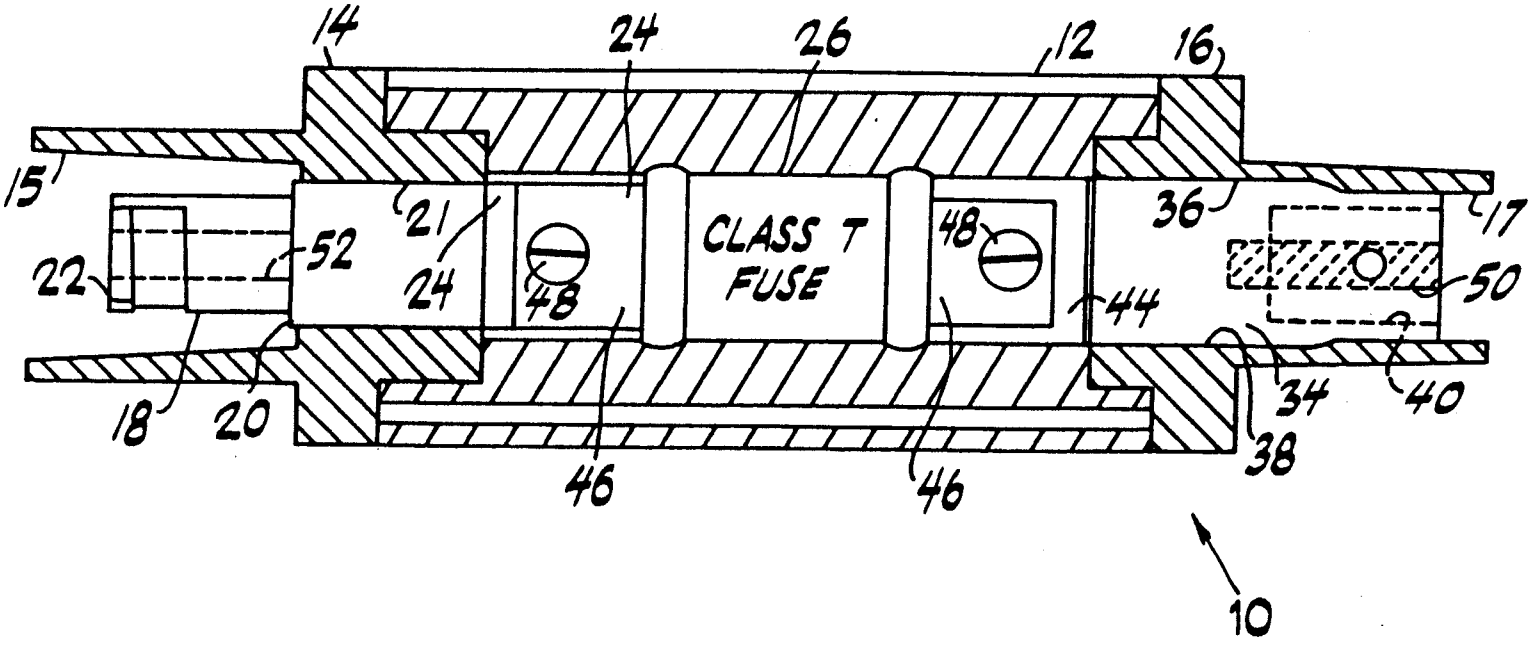
FIG. 2 is a top cross-sectional view of the circuit protection component of FIG. 1.
Figure 4:
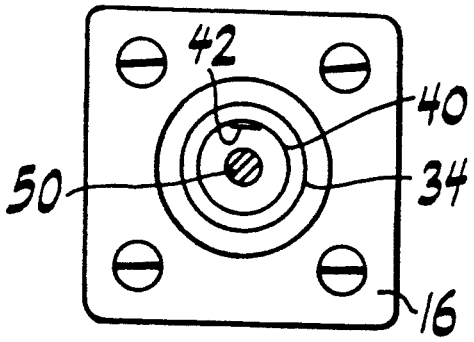
FIG. 4 is an end view of the female connector end of the circuit protection component of FIG. 1.

Referring now to FIGS. 2 and 4, a female connector 34 is securely mounted by the female connector panel mount 16. The female connector 34 comprises an electrically conducting body 36 secured within a central opening 38 of the panel mount 16 and extending within the cylindrical open end 17. A female connector bore 40 is formed within the body 36 at the end thereof within the open end 17 for reception of a male connection element 22, to provide an electrical coupling.

It should be understood that the male connector 18 is meant to be coupled to a female connector having the configuration of the female connector 34 and mounted to an end of a power cable (not shown), and, similarly, the female connector 34 is meant to be coupled to a male connector having the configuration of the male connector 18 and mounted to the end of another power cable (not shown) so as to couple the power cables to one another in a power distribution network.

As illustrated in FIGS. 1 and 4, a projection 42 extends within the bore 40 of the female connector 34. When a female connector 34 is to be coupled to a male connector 18, the projection 42 is aligned with the groove section 30 of the male connector 18 as the male connection element 22 is received within the female connector bore 40 with the projection 42 moving within the groove section 30.

The circumferentially extending groove section 32 is arranged to communicate with the groove section 30 at a distance from the open end 15 sufficient to accommodate a complete insertion of the male connector element 22 within the female connector bore 40. When the male connection element is completely inserted into the bore 40, the two connectors 18, 34 are rotated relative to one another so that the projection 42 moves along the circumferentially extending groove section 32 to lock the connectors to one another. This is because the two connectors cannot now separate due to axial force because the projection 42 abuts against the groove 32 upon the application of an axial force and can only move longitudinally when the two connectors are once again rotated to align the projection 42 with the groove 30. Thus, the groove formation 28 and projection 42 provide a straightforward yet highly effective mechanical lock for connectors when they are coupled to one another.

Referring once again to FIG. 2, the body 36 is also formed to include a cut out portion defining a platform 44. The platforms 24, 44 are spaced from one another and each is arranged to support a flange portion 46 of the fuse 26. The flange portions 46 can each be secured to the respective platforms 24, 44 by a screw 48. Thus, the male and female connectors 18, 34 are electrically coupled to one another by the fuse 26 and thereby provide circuit protection at the location where the component 10 is used to couple two power cables to one another. The component 10 is lightweight and easily used at any location within a power distribution network to place a fuse at any desired local area of the network.

As discussed above, a plurality of component 10 can be strategically located throughout a portable and temporary power distribution system to provide advantageous circuit protection in a highly localized manner for maximum safety.

Figure 3:
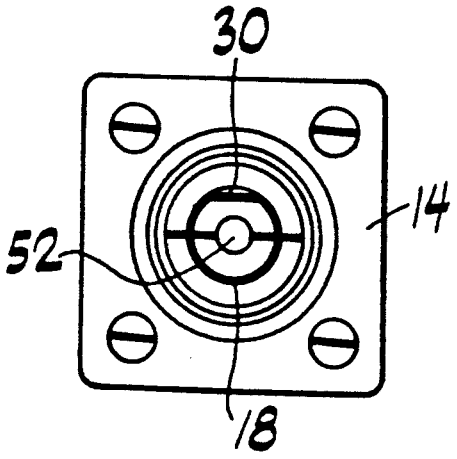
FIG. 3 is an end view of the male connector end of the circuit protection component of FIG. 1.

A further safety feature of the present invention is clearly illustrated in FIGS. 3 and 4. A safety pin 50 is mounted within the female connector bore 40 and arranged to extend along the longitudinal axis of the bore 40. A corresponding opening 52 is found at the longitudinal axis of the male connection element 22. The diameter of each safety pin 50 and opening 52 is fixed to a value corresponding to a power rating for a cable to be coupled to the respective male or female connector 18, 34. For example, a 100 amp cable can be provided with pin/opening diameters, in the respective female and male connectors, of 0.125 inches, with a 200 amp cable having 0.156 inch pin/opening diameters and a 400 amp cable having 0.250 inch pin/opening diameters.

Thus, a 100 amp male connector will have a 0.125 inch opening 52 in its male connection element 22 and will not be able to mate with a 0.250 inch pin diameter of a 400 amp female output, and so on. Accordingly, the male and female connectors 18, 34 of each cable and component 10 used in a portable power network are formed with pin/opening diameters according to the power rating of the cable or the fuse 26 of the component 10. Moreover, the various cable ends and enclosures 12 can be color coded to aid a user in selecting proper power rated components and cables when assembling a power network.

A high amperage fuse will be installed in a component 10 having relatively large pin/opening diameters so that the component 10 is only usable to couple high power rated cables, also with relatively large pin/opening diameters for its connectors. The safety pin arrangement is enforced throughout a portable power network by fitting all power outputs with appropriate safety dimensions. For example, all power outputs comprise female connectors, with the highest amperage outputs having the largest pin diameters, and with the dimension for the pin diameters gradually decreasing for lower amperage outputs. This convention will require a user to select appropriate power rated cables and components with appropriate fuse sizes, as the user assembles the network.

Figure 6:
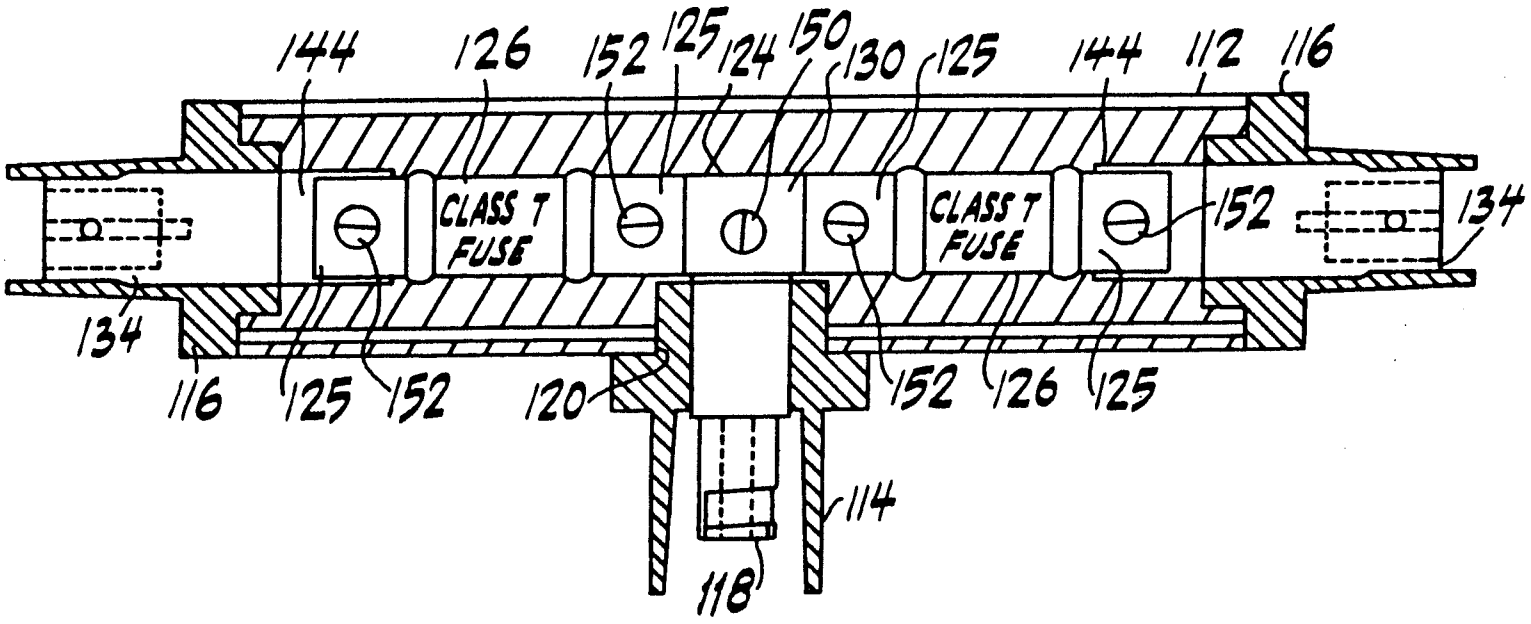
FIG. 6 is a top cross-sectional view of another embodiment of a circuit protection component according to the present invention.

Another embodiment of the present invention is illustrated in FIG. 6. The component 100 of FIG. 6 includes the various components of the component 10 of FIG. 1 arranged to provide a branching connector. To that end, the enclosure 112 mounts two female connector panel mounts 116 at either open end to mount respective female connectors 134. The enclosure 112 is also found to include a side opening 120 to mount a male connector panel mount 114 securely fastening an input male connector 118. The female connectors 134 are formed to provide platforms 144 and the male connector 118 is formed to provide a central platform 124. A bus bar 130 is secured to the central platform 124 by a screw 150 so that flanges 125 of a fuse 126 can be secured between each platform 144 of a corresponding female connector 134 and the bus bar 130 by appropriate screws 152.

The fuses and pin diameters for each female output are appropriate for the rated amperage of the respective branch coupled by the respective female outlet 134. The opening diameter for the male connector 114, on the other hand, is dimensioned to couple to a female connector of a cable having a power rating sufficient to supply power to both branches.

Figure 7:
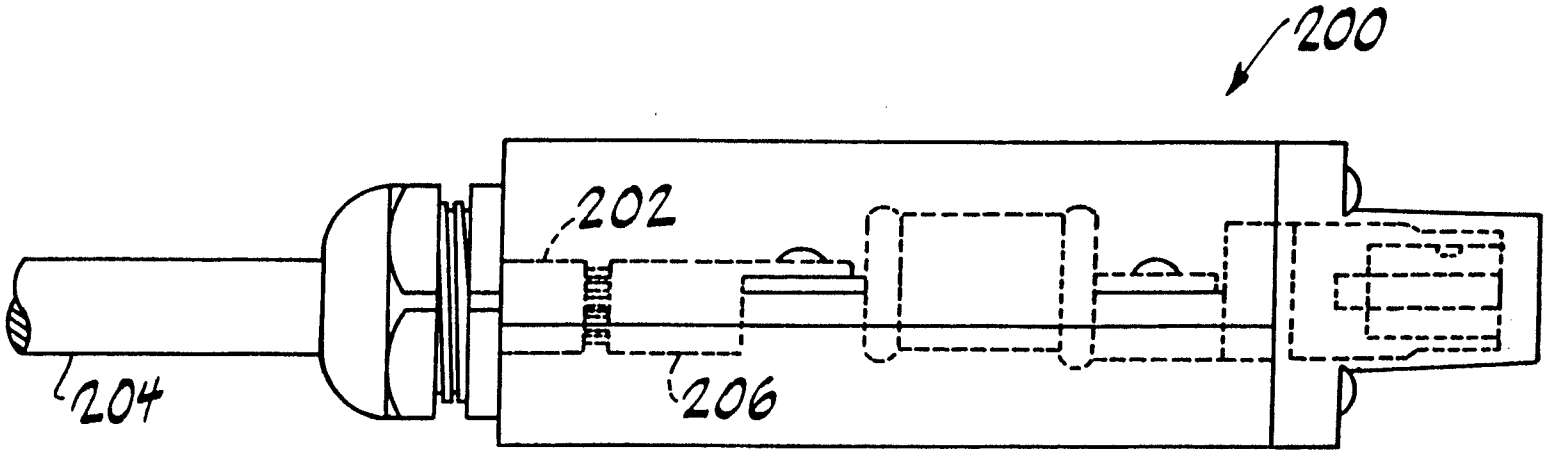
FIG. 7 is a side view of a cable end incorporating a circuit protection component according to the present invention.

FIG. 7 illustrates a component 200 arranged for permanent mounting directly to a cable end. The structure of the component 200 is identical to the component 10, however one of the ends of the enclosure 200 is arranged to receive a bare conductor 202 of a cable 204. A crimping 206 or other appropriate mechanism is utilized to mechanically grasp the conductor 202 within the component 200. Thus, a circuit protection device with an appropriate mechanical connector and safety pin is mounted directly to the end of the cable 204. FIG. 7 illustrates a female connector, however it should be understood that the component 200 can, in the alternative, be fitted with a male connector.

What is claimed is:

1. A portable circuit protection component for use in a power distribution network to couple power cables to one another, the component comprising:

a portable enclosure formed to include at least two electrical connector mountings;

a male electrical connector mounted in one of the electrical connector mountings;

a female electrical connector mounted in the other of the electrical connector mountings; and a circuit protection device mounted within the enclosure and electrically coupling the male electrical connector to the female electrical connector;

the male and female electrical connectors having first and second safety elements, respectively, of predetermined dimensions, the predetermined dimensions being set independently within the range of dimensions of the respective male and female connectors, and corresponding to a power rating for the circuit protection device; and wherein:

the first safety element comprises an opening having a cross-section of the predetermined dimensions and formed to extend in the direction of the longitudinal axis of the male electrical connector, and is adapted to mate only with a second safety element having compatible dimensions, upon coupling of the male electrical connector with a female electrical connector of one of the power cables including a second safety element; and the second safety element comprises a safety pin having a cross-section of the predetermined dimensions and mounted to extend in the direction of the longitudinal axis of the female connector, and is adapted to mate only with a first safety element having compatible dimensions, upon coupling of the female electrical connector with a male electrical connector of another one of the power cables including a first safety element.

2. The portable circuit protection component of claim 1, wherein the circuit protection device comprises a fuse.

3. A portable circuit protection component for use in a power distribution network to couple power cables to one another, the component comprising:

a portable enclosure formed to include at least two electrical connector mountings;

a male electrical connector mounted in one of the electrical connector mountings;

a female electrical connector mounted in the other of the electrical connector mountings;

a circuit protection device mounted within the enclosure and electrically coupling the male electrical connector to the female electrical connector;

the male electrical connector comprising a male connection element having a groove formation formed in an outer surface thereof;

the female electrical connector comprising a body defining a female connector bore;

a projection extending into the female connector bore and adapted for mating with a groove formation of a male electrical connector of one of the power cables;

the groove formation of the male electrical connection element being arranged and configured to permit axial movement of the male connector element during insertion into a female connector bore of a female electrical connector of one of the power cables when the projection of the female connector of one of the power cables is received within the groove formation and the male electrical connector is oriented in a first preselected angular orientation relative to the female connector bore of the power cable, and the groove formation of the male electrical connection element being further arranged and configured to prevent axial movement during insertion into the female connector bore of the power cable when the projection is received within the groove formation and the male electrical connector is oriented in a second preselected angular orientation relative to the female connector bore of the power cable.

4. The portable circuit protection component of claim 3, wherein the groove formation comprises a longitudinally extending groove in communication with a circumferentially extending groove and wherein the first preselected angular orientation corresponds to an alignment between the longitudinally extending groove and the projection and the second preselected angular orientation corresponds to the projection being received into the circumferentially extending groove.

5. The portable circuit protection component of claim 3, wherein the circuit protection device comprises a fuse.

6. The portable circuit protection component of either one of claim 1 or claim 3 wherein the portable enclosure includes a plurality of electrical connector mountings, with the electrical connector mounted in one of the electrical connector mountings forming an electrical input and the electrical connectors mounted in the other electrical connector mountings forming electrical outputs; and a plurality of circuit protection devices mounted within the enclosure, each of the circuit protection devices coupling the electric input to a preselected one of the electric outputs.

* * * * *